US006367881B1

(12) United States Patent
Bullard et al.

(10) Patent No.: US 6,367,881 B1
(45) Date of Patent: Apr. 9, 2002

(54) COIL SEATING ASSEMBLY

(75) Inventors: Larry I. Bullard, Winston-Salem; Vernon L. Bigsby, Hickory, both of NC (US); Richard A. Bozynski, Sebring, FL (US); Allen R. Sigmon, High Point, NC (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/417,664

(22) Filed: Oct. 14, 1999

(51) Int. Cl.[7] ..... A47C 7/02
(52) U.S. Cl. ..... 297/452.5
(58) Field of Search ..... 297/452.5, 452.51; 267/91, 92, 94, 101, 131, 142; 5/654.1, 655.7, 655.8

(56) References Cited

U.S. PATENT DOCUMENTS

| | | | | |
|---|---|---|---|---|
| 1,695,072 A | * | 12/1928 | Wedler | |
| 2,048,979 A | * | 7/1936 | Trotta et al. | 5/353 |
| 2,862,214 A | | 12/1958 | Thompson et al. | 5/353 |
| 3,165,761 A | * | 1/1965 | Ross | 5/351 |
| 3,462,779 A | | 8/1969 | Thompson | 5/353 |
| 3,869,739 A | | 3/1975 | Klein | 5/353 |
| 4,173,803 A | | 11/1979 | Kennedy | 5/13 |
| 4,986,518 A | * | 1/1991 | Stumpf | 267/91 |
| 5,127,365 A | * | 7/1992 | Long et al. | |
| 6,131,892 A | * | 10/2000 | Stumpf | |

FOREIGN PATENT DOCUMENTS

FR 2470088 5/1981

* cited by examiner

*Primary Examiner*—Milton Nelson, Jr.
(74) *Attorney, Agent, or Firm*—Shook, Hardy & Bacon L.L.P.

(57) ABSTRACT

A coil seating assembly is provided for use in a piece of furniture. The assembly includes a plurality of spring coils and a casing within which the coils are received. The coils each define a central longitudinal axis and are deformable in the direction of the axis between an extended, unloaded condition and a compressed, loaded condition. The casing includes a plurality of pockets, each of which encases one of the spring coils and includes side, top and bottom walls that collectively define an interior space sized for receipt of the coil when the coil is deformed from the unloaded condition. The pockets are sized to restrict extension of the coils from the compressed, loaded condition such that the coils are maintained in the loaded condition within the pocket. The pocketed coils are arranged in rows, and a plurality of the rows of pocketed coils are secured together by one or more cover sheets to form the assembly.

2 Claims, 2 Drawing Sheets

COIL SEATING ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to furniture components, and more particularly to a seating assembly for a chair, sofa or the like, wherein the assembly includes a plurality of preloaded spring coils for providing resilient support of an individual sitting on the furniture.

It is conventional to provide a coil seating assembly for a chair, love seat or sofa, wherein the seating assembly includes a plurality of spring coils that are bound together and secured to a base, e.g. by an 8-way hand tie arrangement or the like. Typically, the spring coils are slightly compressed or preloaded when tied down to the base or frame to increase the support provided by the assembly.

Although the known seat assembly construction performs in a satisfactory manner, it would be desirable to reduce the cost and complexity of the assembly, and to provide a construction that possesses all the advantages of the conventional construction while adding further benefits. For example, because the known construction requires a time-consuming hand-tying operation requiring skilled craftsmanship to install, it would be desirable to provide a comparable construction that could be employed with less labor or skill. Such a construction would reduce the cost of the assembly, and of the piece of furniture into which the assembly is installed.

In addition, because the coils of a conventional seating assembly are preloaded during construction by tying the assembly down to the base, the base is also loaded, increasing the total load experienced by the base. As such, the base must be designed to bear the added load exerted by the coils, increasing the cost of the furniture being manufactured.

BRIEF SUMMARY OF THE INVENTION

The present invention generally relates to a coil seating assembly for use in a piece of furniture, and broadly includes a plurality of spring coils that are preloaded by a fabric casing defined by a plurality of individual pockets within which the coils are received. The spring coils each define a central longitudinal axis and are deformable in the direction of the axis between an extended, unloaded condition and a compressed, loaded condition. The pocket encasing each spring coil defines an interior space sized for receipt of one of the coils only when the coil is deformed from the unloaded condition. As such, the pockets restrict extension of the coils from the compressed, loaded condition such that the coils are maintained in the loaded condition within the pockets.

By providing a seating assembly in accordance with the present invention, numerous advantages are realized. For example, by providing an assembly in which every spring coil is preloaded within a pocket of the casing, it is possible to provide an assembly having the desired support characteristics without also preloading the base or frame of the furniture as well. As such, the frame need not be constructed to support both the preload and live load to be experienced by the furniture. In addition, by providing the assembly as a modular unit in which the preloaded condition of the coils is maintained apart from the remainder of the piece of furniture being manufactured, installation of the unit into the furniture is simplified, and relatively complex hand tying operations are not required. This significantly reduces the cost of manufacture of the furniture, as well as the level and amount of skilled craftsmanship required.

BRIEF DESCRIPTION OF THE SEVERAL VIEWS OF THE DRAWING

The present invention is described in detail below with reference to the attached drawing, wherein.

DETAILED DESCRIPTION OF THE INVENTION

Figure 1:
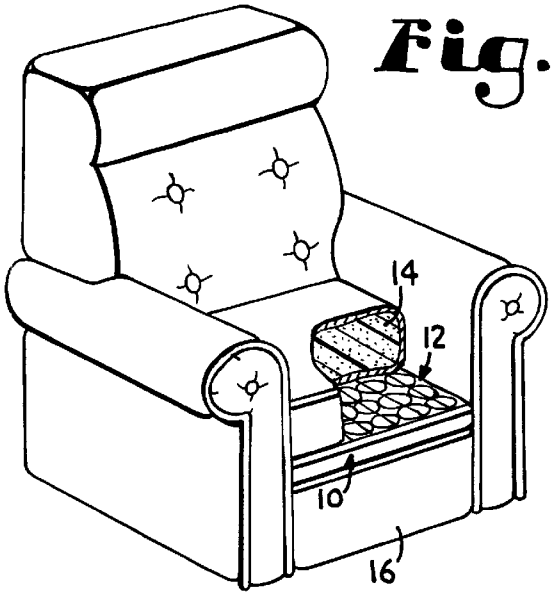
FIG. 1 is perspective view of a chair including a coil seating assembly constructed in accordance with the present invention.

A chair including a coil seating assembly constructed in accordance with the present invention is illustrated in FIG. 1, and broadly includes a structural frame 10, the seating assembly 12, a seat cushion 14 or the like placed on top of the seating assembly, and upholstery 16 covering the frame. For purposes of the following description, the frame and upholstery of the chair will be considered conventional unless otherwise identified. As such, the construction of the frame and upholstery forms no part of the present invention, and the invention can be employed with any desired type of frame or upholstery without departing from the scope of the claims presented herein.

Figure 2:
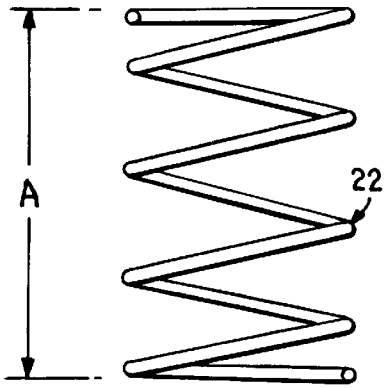
FIG. 2 is a perspective view of a spring coil forming a part of the coil seating assembly.
Figure 6:
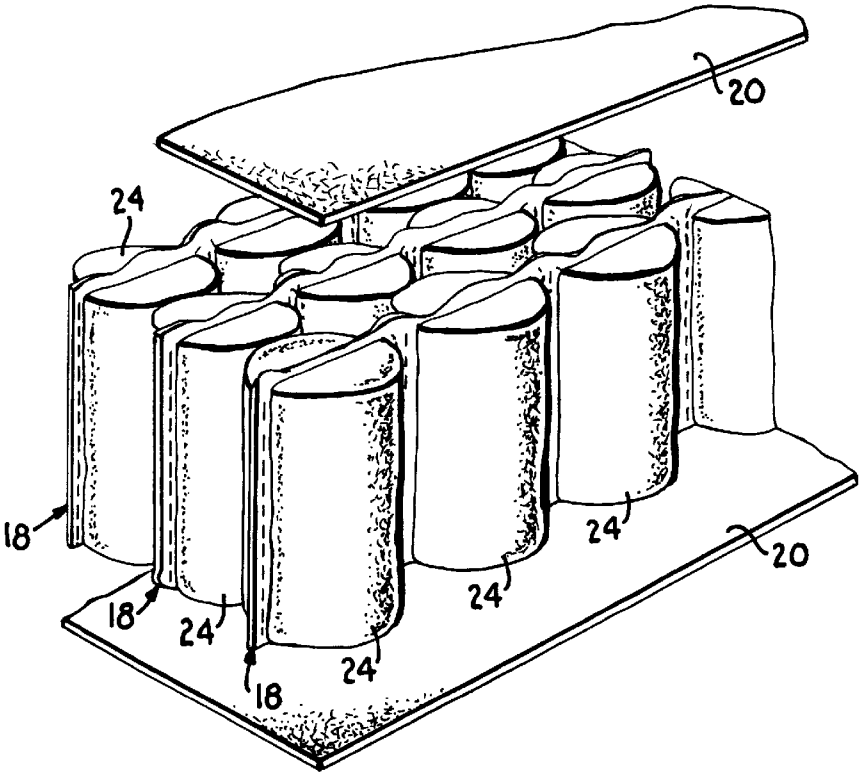
FIG. 6 is an exploded fragmentary perspective view of the assembly.

The seating assembly 12 of the present invention is shown apart from the chair in FIG. 6, and includes a plurality of rows 18 pocketed coils that are placed side-by-side and secured together by cover sheets 20 to form a modular array of any desired dimensions. With reference to FIG. 2, the spring coils 22 used in the assembly are substantially similar to one another, except with reference to the alternate construction described below with reference to FIG. 8. Each spring coil 22 is constructed of a single wire formed into a helix to present a compression spring coil having a predetermined spring rate that is dictated by the number, size and spacing of the helical windings, and the gauge and type of material used to form the coil. The selection of the spring coils is dependent on the requirements of the particular piece of furniture for which the assembly is being designed, and thus may vary from application to application.

Preferably, the spring coils 22 are each generally barrel shaped, wherein the helical windings in the middle section of the coil are of a larger diameter than the end windings. This construction provides a beneficial variable spring rate. However, other coil configurations may also be used to achieve desired support characteristics.

Figure 5:
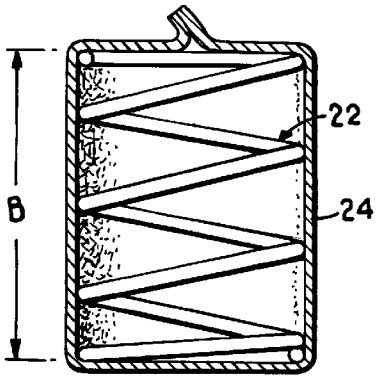
FIG. 5 is a sectional view taken along line 5—5 of FIG. 4.

As shown in FIG. 5, each coil 22 is encased in a pocket 24 of the assembly, and is preloaded by the pocket such that the height "B" of the pocketed coils is less than the height "A" of the unloaded coils, as designated in FIG. 2. Preloading of the coils is obtained by forming each pocket 24 with dimensions smaller than those of the coil 22 such that in order for the pocket to be closed around the coil, the coil must first be partially compressed. As such, the interior space defined by each pocket is smaller than the space occupied by one of the coils 22 in the unloaded condition of the coil. In other words, the sum of the height and diameter of each pocket is smaller than the sum of the height "A" and diameter of the coil to be received therein.

Each pocket 24 is constructed of a fabric, such as non-woven polypropylene, that is wrapped around one of the coils 22 and closed to restrict extension of the coil from its preloaded condition. Preferably, the pocket includes a piece of fabric that is wrapped around one end of the coil such that the opposed edges of the fabric can be brought together adjacent the opposite end of the coil and secured together. By providing this construction, the coil can be compressed slightly when the edges are brought together and secured in place, resulting in a construction in which the coil remains preloaded regardless of whether the assembly is secured to the frame of a piece of furniture.

Figure 3:
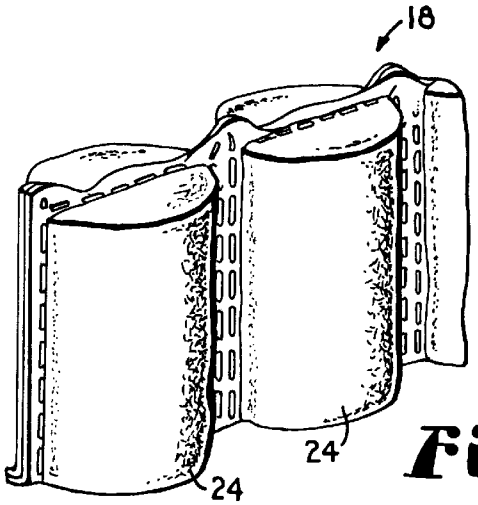
FIG. 3 is a fragmentary perspective view of a plurality of pocketed coils forming a part of the coil seating assembly.
Figure 4:
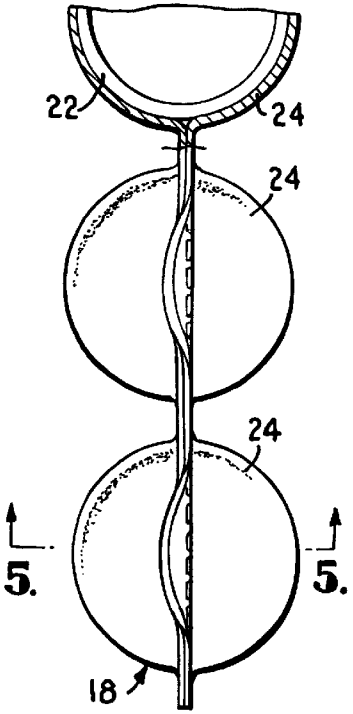
FIG. 4 is a fragmentary top plan view of the row of pocketed coils.

Turning to FIG. 3, a plurality of the pockets 24 are illustrated as being formed in each row 18 from a single strip of fabric. In order to construct the row of pockets, the strip of fabric is wrapped around one end of the coils while the coils are maintained in an orientation parallel to one another. Thereafter, the opposing edges of the strip are brought together adjacent the opposite ends of the coils and secured together. At the time the edges are secured, the coils 22 in the row are compressed so that the coils remain preloaded due to the restraints placed on the coils by the pockets 24. In addition, each coil is separated from the other coils in the row by securing opposite sides of the strip of fabric together in the spaces between the coils. As such, each coil 22 is encased within an individual pocket defined by the strip of material, and can neither extend outwardly from the preloaded condition or be turned on its axis.

The edges of the fabric can be secured together to form the pockets by stitching, adhering, melting, welding or otherwise securing them together, and the spaces between the coils 22 are preferably closed off by employing the same or an equivalent method. In an exemplary embodiment, the individual pockets 24 are formed from the strip by spot welding the opposing fabric layers together along the top and sides of each pocket.

Returning to FIG. 6, the top and bottom cover sheets 20 of the assembly are illustrated as being applied to the top and bottom sides of a number of rows of pocketed coils to form an array in which the rows of coils are located side-by-side, and the coils within the rows are generally aligned with the coils in adjacent rows. The cover sheets are preferably formed of the same fabric as the pockets, e.g. non-woven polypropylene, and are secured to the pockets by tying, stitching, adhering, welding, gluing or otherwise securing them to the fabric of the pockets. As such, a unitary construction results in which all of the coils are arranged in an orientation parallel to one another, and are preloaded to provide the desired level of support in the piece of furniture in which the assembly is installed.

Figure 7:
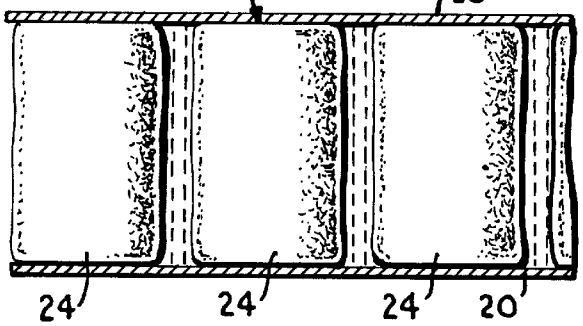
FIG. 7 is a fragmentary side elevational view of the assembly.

As shown in FIG. 7, the assembly includes a plurality of rows of coils of substantially identical construction. The rows are arranged so that when the assembly is installed on a piece of furniture, each row extends either laterally between the sides of the furniture, or front to back. This construction may be referred to as a hard-edged construction.

Figure 8:
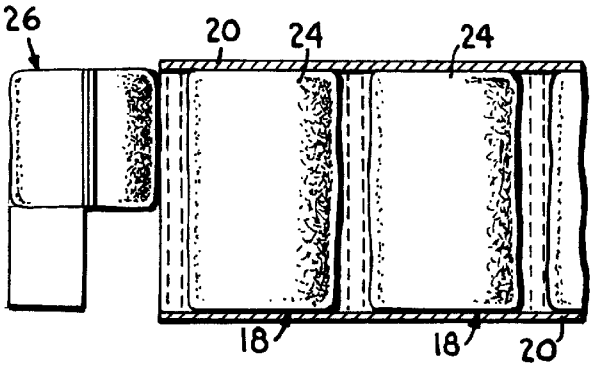
FIG. 8 is a fragmentary side elevational view of the assembly, illustrating an alternate front edge construction thereof.

Turning to FIG. 8, an alternate construction is illustrated, wherein a front row 26 of coils is shorter than the remaining rows. This construction may be referred to as a spring-edged construction and can either be prefabricated or provided as separate components. Preferably, the coils used in the front row of the assembly are firmer than the coils used throughout the remainder of the assembly. However, as with the remaining coils, the coils of the front row are preferably pocketed with the coils preloaded. As such, the same benefits are realized as with the hard-edged construction of FIG. 7. In the spring-edged construction of FIG. 8, the front row of pocketed coils are preferably stapled to the frame of a piece of furniture and, if provided separate from the remainder of the assembly, glued or hog ringed to the adjacent pocketed coils at the time of manufacture of the furniture.

The assembly can be constructed in one or more standardized sizes so that no modifications to the assembly are required in order to use it in the manufacture of various pieces of furniture. Preferably, a single assembly is sized for use in a chair, and two or three assemblies can be easily secured together in the manufacture of a love seat or sofa. If plural assemblies are to be used together, fabric strips can be glued between adjacent assemblies or fiber seat deck pads can be employed. Further, if the depth of the area to be supported exceeds the depth of the seating assemblies, additional rows of pocketed, preloaded coils can be provided to extend the area of support of the assembly. If such single row arrays of pocketed coils are employed, they can be secured to an adjacent seating assembly by gluing, hog ringing or any other suitable method.

Although the present invention has been described with reference to a preferred embodiment as illustrated in the drawing, it is noted that substitutions may be made and equivalents employed herein without departing from the scope of the invention as recited in the claims.

What is claimed is:

1. A coil seating assembly for use in a piece of furniture, the assembly comprising:

a plurality of spring coils each defining a central longitudinal axis and being deformable in the direction of the axis between an extended, unloaded condition and a compressed, loaded condition;

a pocket encasing each spring coil and including side, top and bottom walls that collectively define an interior space sized for receipt of one of the coils when the coil is deformed from the unloaded condition, the side, top and bottom walls of the pocket being sized to restrict extension of the coil from the compressed, loaded condition such that the pocketed coil is maintained in the loaded condition; and a fabric cover sheet secured to the tops of the pockets to secure the pockets together in the assembly, wherein the cover sheet includes a non-woven polypropylene, wherein a first plurality of the pocketed coils are secured together in a row with the axes of the coils encased in the pockets extending generally parallel to one another, the row of pocketed coils extending in a direction generally transverse to the axes of the individual coils encased in the pockets, and wherein a plurality of rows of pocketed coils are secured together to form the assembly.

2. A coil seating assembly for use in a piece of furniture, the assembly comprising:

a plurality of spring coils each defining a central longitudinal axis and being deformable in the direction of the axis between an extended, unloaded condition and a compressed, loaded condition;

a pocket encasing each spring coil and including side, top and bottom walls that collectively define an interior space sized for receipt of one of the coils when the coil is deformed from the unloaded condition, the side, top and bottom walls of the pocket being sized to restrict extension of the coil from the compressed, loaded condition such that the pocketed coil is maintained in the loaded condition; and a fabric cover sheet secured to the bottoms of the pockets to secure the pockets together in the assembly, wherein the cover sheet includes a non-woven polypropylene, wherein a first plurality of the pocketed coils are secured together in a row with the axes of the coils encased in the pockets extending generally parallel to one another, the row of pocketed coils extending in a direction generally transverse to the axes of the individual coils encased in the pockets, and wherein a plurality of rows of pocketed coils are secured together to form the assembly.

* * * * *